US006681556B2

(12) United States Patent
Mistry et al.

(10) Patent No.: US 6,681,556 B2
(45) Date of Patent: Jan. 27, 2004

(54) APPARATUS FOR DECREASING COMBUSTOR EMISSIONS

(75) Inventors: Jagdish Dullabhbhai Mistry, Cincinnati, OH (US); James William Stegmaier, West Chester, OH (US)

(73) Assignee: General Electric Company, Schenectady, NY (US)

( * ) Notice: Subject to any disclaimer, the term of this patent is extended or adjusted under 35 U.S.C. 154(b) by 107 days.

(21) Appl. No.: 10/141,653

(22) Filed: May 8, 2002

(65) Prior Publication Data

US 2003/0154722 A1 Aug. 21, 2003

Related U.S. Application Data

(62) Division of application No. 09/640,356, filed on Aug. 16, 2000, now Pat. No. 6,405,524.

(51) Int. Cl.[7] ..... F02C 7/232
(52) U.S. Cl. ..... 60/39.094; 60/739
(58) Field of Search ..... 60/39.094, 739; 431/278

(56) References Cited

U.S. PATENT DOCUMENTS 5,036,657 A * 8/1991 Seto et al. ..... 60/739
5,321,949 A * 6/1994 Napoli et al. ..... 60/739
5,927,067 A * 7/1999 Hanloser et al. ..... 60/39.094

* cited by examiner

*Primary Examiner*—Louis J. Casaregola
(74) *Attorney, Agent, or Firm*—William Scott Andes; Armstrong Teasdale LLP; Robert B. Reeser, III

(57) ABSTRACT

A combustor for a gas turbine engine includes a fuel delivery system that uses circumferential fuel staging. The fuel delivery system includes a plurality of fuel supply rings and a backpurge sub-system. The fuel supply rings are arranged concentrically at various radial distances to supply fuel to a combustor through a plurality of combustor manifolds and pigtails. The backpurge system uses high temperature and high pressure combustor air to purge fuel from non-flowing fuel supply rings, combustor pigtails, and combustor manifolds. Additionally, the fuel delivery system includes at least two orifices to minimize pressure decays during filling stages.

6 Claims, 2 Drawing Sheets

APPARATUS FOR DECREASING COMBUSTOR EMISSIONS

This is a Division of application Ser. No. 09/640,356 filed Aug. 16, 2000 (U.S. Pat. No. 6,405,524).

BACKGROUND OF THE INVENTION

This application relates generally to combustors and, more particularly, to fuel delivery systems for gas turbine engine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Most aircraft engines are able to meet current emission standards using combustor technologies and theories proven over the past 50 years of engine development. However, with the advent of greater environmental concern worldwide, there is no guarantee that future emissions standards will be within the capability of current combustor technologies.

In general, one class of engine emissions (NOx) are formed because of high flame temperatures within a combustor. Combustor flame temperature is controlled by increasing airflow during periods of increased fuel flow in an effort to evenly meter combustor flame temperature across the combustor. Known combustors inject fuel through a plurality of premixers that are arranged circumferentially at various radial distances from a center axis of symmetry for the combustor. To achieve a full range of engine operability, such combustors include fuel delivery systems that circumferentially stage fuel flows through the premixers to evenly disperse fuel throughout the combustor.

Such combustors are in flow communication with external boost air systems. As engine power is increased, fuel is injected through premixers at different radial distances. To reduce auto-ignition of fuel, residual fuel is purged from non-flowing premixers with the external boost air system. Because of the various fuel supply and premixer configurations that are used during fuel staging, such external boost air systems are often elaborate and complex. However, despite such complex boost air systems, during fuel stage transitions, pressure decays may occur as a result of the purging. Such pressure decays may cause an overtemperature or overspeed within the turbine.

BRIEF SUMMARY OF THE INVENTION

In an exemplary embodiment, a combustor for a gas turbine engine includes a fuel delivery system that uses circumferential fuel staging and combustor air pressure for purging residual fuel from non-flowing engine components. The fuel delivery system includes a plurality of fuel supply rings and a backpurge sub-system. The plurality of fuel supply rings arc arranged concentrically at various radial distances to supply fuel to a turbine engine combustor through a plurality of combustor manifolds and pigtails. The backpurge system uses combustor air to purge fuel from non-flowing fuel supply rings, combustor pigtails, and combustor manifolds. Additionally, the fuel delivery system includes at least two orifices to minimize pressure decays during filling stages.

During engine operation, as power is adjusted, fuel delivery system fuel stages supply fuel to the combustor through various combinations of fuel supply rings. The backpurge system drains and dries residual fuel from the non-flowing fuel supply rings and any associated combustor components. Because the backpurge system uses combustor air at a high pressure and temperature, residual fuel is easily removed and auto-ignition of the residual fuel is reduced. As a result, a combustor is provided that is cost-effective and highly reliable,

DETAILED DESCRIPTION OF THE INVENTION

Figure 1:
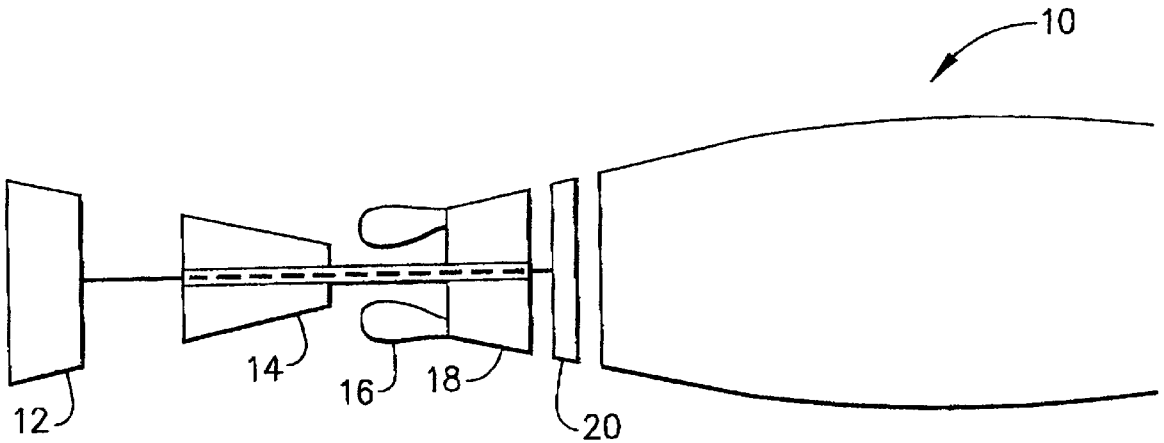
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
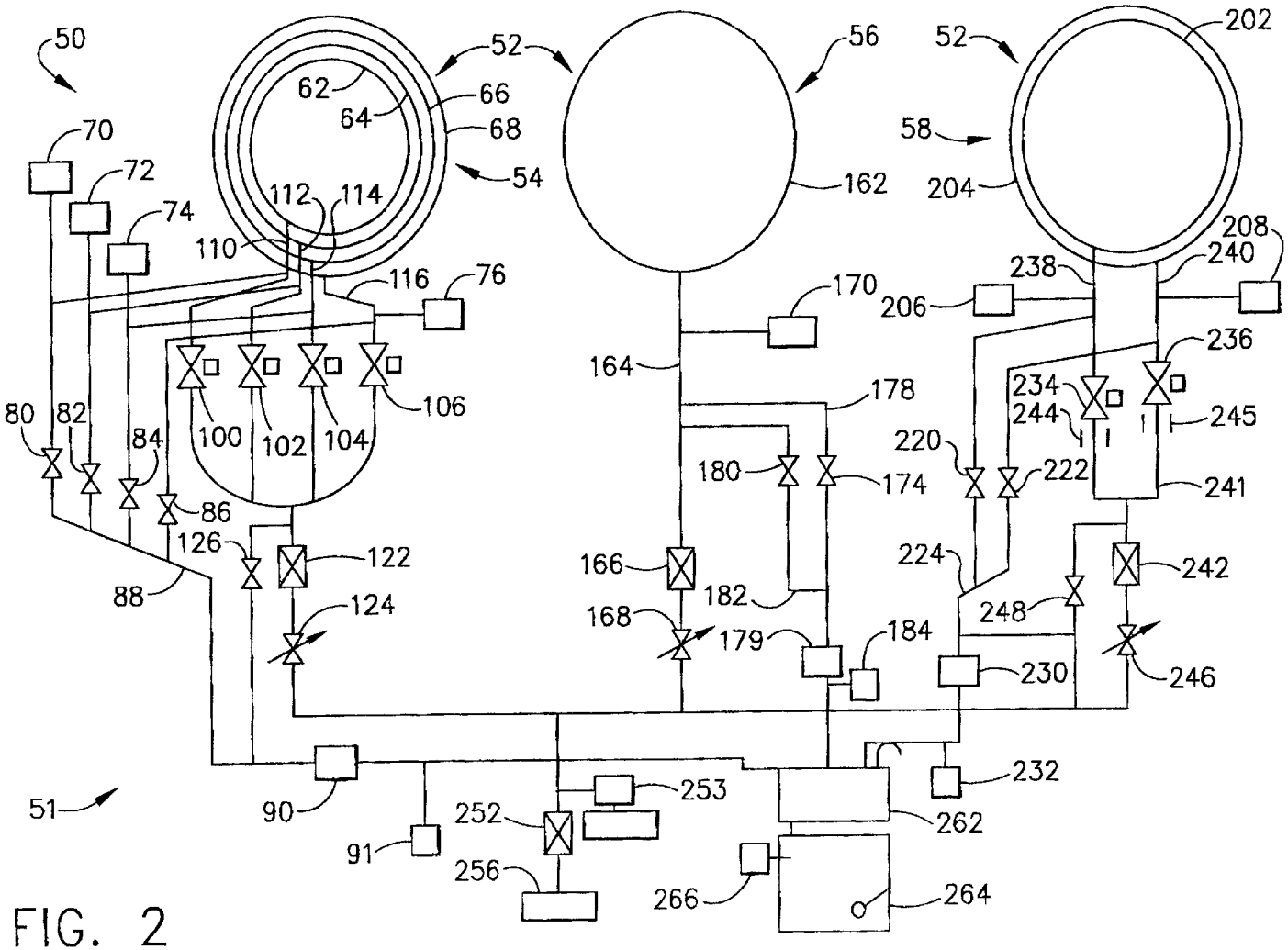
FIG. 2 is a schematic illustration of a fuel delivery system used with the gas turbine engine shown in FIG. 1

FIG. 2 is a schematic illustration of a fuel delivery system 50 for use with a gas turbine engine, similar to engine 10 shown in FIG. 1. In one embodiment, the gas turbine engine is an LM6000 engine available from General Electric Company, Cincinnati, Ohio. In an exemplary embodiment, fuel delivery system 50 includes a backpurge sub-system 51 to purge and drain liquid from non-flowing portions of fuel delivery system 50 to meet load and speed variations during engine accelerations and decelerations or fuel transfers. Backpurge subsystem 51, described in more detail below, uses high temperature and pressurized combustor air pressure to drain and purge fuel from non-flowing portions of fuel delivery system 50.

Flame temperatures within combustor 16 (shown in FIG. 1) control liquid fuel emissions and as a result, combustor 16 uses circumferential staging to achieve full engine operability. Fuel delivery system 50 includes a plurality of fuel supply manifold rings 52 arranged concentrically with respect to each other. In one embodiment, rings 52 are fabricated from metal. Specifically, fuel supply manifold rings 52 include an "A" ring group or radially outer group 54, a "B" ring group or intermediate group 56, and a "C" ring group or radially inner group 58. In one embodiment, rings 52 are approximately 0.5" diameter stainless steel tubes. In another embodiment, rings 52 are approximately 0.625" diameter stainless steel tubes. In a further embodiment, rings 52 are approximately 0.375" diameter stainless steel rings. Each group 54, 56, and 58 is connected to a plurality of manifolds (not shown). Each combustor manifold includes a plurality of pigtails (not shown) that connect each manifold to a combustor premixer (not shown). In one embodiment, fuel delivery system 50 is a liquid fuel system for a dual fuel engine. In another embodiment, fuel delivery system 50 is a dry low emission (DRE) liquid fuel system.

"A" ring group 54 includes four fuel supply manifold rings 52 for supplying fuel to combustor manifolds. Fuel supply manifold rings 52 are concentrically aligned with respect to each other and are positioned substantially coplanar with respect to each other. A smallest diameter manifold ring 62 is known as an A1 ring and is radially inward from a second fuel supply ring 64 known as an A2 ring. A third fuel supply ring 66 is known as an A3 ring and is radially outward from A2 ring 64 and is radially inward from a fourth supply ring 68 known as an A4 ring.

Each fuel supply ring 62, 64, 66, and 68 includes a temperature/pressure sensor 70, 72, 74, and 76, respectively, connected between each respective manifold ring 60 and a respective purge valve 80, 82, 84, and 86. Purge valves 80, 82, 84, and 86 are commonly connected with piping 88 extending between purge valves 80, 82, 84, and 86, and a heat exchanger 90. A temperature sensor 91 monitors a temperature of combustor air flowing through heat exchanger 90.

Each fuel supply ring 62, 64, 66, and 68 also includes a staging valve 100, 102, 104, and 106, respectively. Common piping 110, 112, 114, and 116 connect each staging valve 100, 102, 104, and 106, and each respective purge valve 80, 82, 84, and 86, to each "A" group fuel supply ring 62, 64, 66, and 68, respectively. Each staging valve 100, 102, 104, and 106 are commonly connected with piping 120 extending between staging valves 100, 102, 104, and 106 and an "A" group shut-off valve 122.

"A" group shut-off valve 122 controls a flow of fuel to staging valves 100, 102, 104, and 106 and is between staging valves 100, 102, 104, and 106 and an "A" group fuel metering valve 124. An "A" drain valve 126 is connected to piping 120 between "A" group shut-off valve 122 and staging valves 100, 102, 104, and 106, and extends to connect with piping 88 between heat exchanger 90 and purge valves 80, 82, 84, and 86. In the exemplary embodiment, back purge sub-system 51 includes "A" drain valve 126, purge valves 80, 82, 84, and 86, and staging valves 100, 102, 104, and 106.

"B" ring group 56 includes one fuel supply manifold ring 52 for supplying fuel to combustor manifolds. Specifically, a fuel supply manifold ring 162 is known as a "B" ring and is radially inward from "A" group rings 60. Fuel supply ring 162 is connected with piping 164 to a "B" group fuel shut-off valve 166. "B" group fuel shut-off valve 166 controls a flow of fuel to "B" ring group 56 and is between manifold ring 162 and a "B" group fuel metering valve 168. A temperature/pressure sensor 170 is connected between manifold ring 162 and "B" group shut-off valve 166.

A purge valve 174 is connected with piping 178 to piping 164 between temperature/pressure sensor 170 and "B" group shut-off valve 166. Piping 178 extends from purge valve 174 to a heat exchanger 179. A "B" group drain valve 180 is connected with piping 182 to piping 164 between purge valve piping 178 and heat exchanger 179. Drain valve piping 182 is also connected to purge valve piping 178 between purge valve 174 and heat exchanger 179. A temperature of combustor air flowing through heat exchanger 179 is monitored with a temperature sensor 184. In the exemplary embodiment, back purge sub-system 51 also includes drain valve 180 and purge valve 174.

"C" ring group 58 includes two fuel supply manifold rings 52 for supplying fuel to combustor manifolds. Manifold rings 52 within "C" ring group 58 are concentrically aligned with respect to each other and are radially inward from "B" ring group manifold ring 162. A smallest diameter manifold ring 202 is known as a C1 ring and is radially inward from a second fuel supply ring 204 known as a C2 ring.

Each fuel supply ring 202 and 204 includes a temperature/pressure sensor 206 and 208 respectively, connected between each respective manifold ring 52 and a respective purge valve 220 and 222. Purge valves 220 and 222 are commonly connected with piping 224 extending between purge valves 220 and 222, and a heat exchanger 230. A temperature sensor 232 monitors a temperature of combustor air flowing through heat exchanger 230.

Each fuel supply ring 202 and 204 also includes a staging valve 234 and 236, respectively. Common piping 238 and 240 connect each staging valve 234 and 236, and each respective purge valve 220 and 222 to each "C" group fuel supply ring 202 and 204, respectively. Each staging valve 234 and 236 are commonly connected with piping 241 extending between staging valves 234 and 236 and a "C" group shut-off valve 242. A pair of orifices 244 and 245 are between each staging valve 234 and 236 and "C" group shut-off valve 242.

"C" group shut-off valve 242 controls a flow of fuel to staging valves 234 and 236 and is between staging valves 234 and 236 and a "C" group fuel metering valve 246. A drain valve 248 is connected to piping 240 between "C" group shut-off valve 242 and staging valves 234 and 236, and extends to connect with piping 224 between heat exchanger 230 and purge valves 220 and 222. In the exemplary embodiment, back purge sub-system 51 also includes drain valve 248, purge valves 220 and 222, and staging valves 234 and 236.

Each group fuel metering valve 124, 168, and 246 is commonly connected with piping 250 to a fuel delivery system main shut-off valve 252. A temperature/pressure sensor 253 is connected to piping 250 between fuel metering valves 124, 168, and 246 and fuel delivery system main shut-off valve 252. Fuel delivery system main shut-off 252 is in flow communication with a liquid fuel source 256 and controls a flow of fuel to fuel delivery system supply ring groups 54, 56, and 58.

Each group heat exchanger 90, 179, and 230 is commonly connected with piping 260 to a fuel/air separator 262 that is in flow communication with a drain tank 264. A temperature sensor 266 is connected to drain tank 264 and monitors a temperature of fluid entering drain tank 264. Drain tank 264 is at ambient pressure. The combination of fuel/air separator 262 and heat exchangers 90, 179, and 230 control a temperature of purge air entering drain tank 264. In one embodiment, purge air temperature entering drain tank 264 is less than approximately 100° F.

During engine operation, fuel delivery system 50 operates with circumferential staging. Initially when engine 10 is being started and increased in power, fuel is supplied to combustor 16 through "B" ring group 56 and A1 ring 62. As power is increased, a next fuel stage supplies fuel to only "B" ring group 56. During engine operations as a fuel flow to various fuel supply rings 52 is shutoff, backpurge sub-system 51 uses combustor air to remove residual liquid fuel from non-flowing supply rings 52 to prevent auto-ignition of the fuel. Because combustor air is provided internally at a higher temperature and pressure than air provided with known purge systems, overtemperatures and overspeeds of turbine 10 are reduced during purging.

Specifically, during engine start, as fuel staging is changed from supplying fuel to "B" ring group 56 and A1 ring 62 to only supplying fuel to "B" ring group 56, fuel flow to A1 ring group 56 is shut-off and backpurge sub-system 51 removes fuel from A1 premixers, pigtails, and A1 ring 62 by sequencing valves. Initially "A" ring group fuel shutoff valve 122 is closed, and A1 purge valve 80 and "A" drain valve 126 are opened. After approximately two minutes, and A1 purge valve 80, "A" drain valve 126, and A1 staging valve 100 are closed to complete a purging cycle.

As engine power is further increased, another fuel stage permits fuel is be supplied to "B" ring group 56 and "C" ring 202. During such a fuel stage, fuel is supplied to C1 ring 202 after "C" group shutoff valve 242 and C1 staging valve 234 are opened. As power is further increased, fuel is then supplied to "B" ring group 56 and "C" ring group 58 and C2 ring 204 is filled after C2 staging valve 236 is opened. Because fuel flows through orifices 244 and 245 prior to entering staging valves 234 and 236, respectively, load variations and manifold pressure decay are reduced during such the fuel stage transition.

As engine power is further increased, a next fuel stage shuts-off fuel flow to "C" ring group 58 and supplies fuel to "A" ring group 54 and "B" ring group 56. During such a fuel stage, "A" group shut-off valve 122 and "A" staging valves 100, 102, 104, and 106 are opened. "C" ring group shut-off valve 242 is then closed, and C1 and C2 purge valves 220 and 222, respectively, and "C" ring group drain valves 248 are opened. Approximately two minutes later, C1 and C2 staging valves 234 and 236, respectively, C1 and C2 purge valves 220 and 222, respectively, and "C" ring group drain valve 248 are closed and purging is complete.

As power is further increased, fuel is supplied to "A", "B", and "C" ring groups 54, 56, and 58, respectively. During such fuel staging, fuel is supplied to "C" rings 202 and 204 after "C" ring group shutoff valve 242, and C1 and C2 staging valves 234 and 236, respectively, are opened.

Engine 10 is also operated with circumferential staging as power is decreased from high power operations. Prior to reductions in power, engine 10 operates with fuel supplied to "A", "B", and "C" ring groups 54, 56, and 58, respectively. Depending on particular a particular engine 10, flow rates to "A", "B", and "C" ring groups 54, 56, and 58, respectively, will change depending upon power operating levels of engine 10. As power is decreased, fuel is then initially supplied to only "A" ring group 54 and "B" ring group 56, and fuel is purged from "C" ring group premixers, pigtails, and manifolds 202 and 204 after "C" ring group shut-off valve 242 is closed. C1 and C2 purge valves 220 and 222, respectively, and "C" group drain valve 248 are then opened. Approximately two minutes later, C1 and C2 staging valves 234 and 236, respectively, C1 and C2 purge valves 220 and 222, respectively, and "C" ring group drain valve 248 are closed and purging is complete.

As power is further decreased, fuel is then supplied through another fuel stage to only "B" ring group 56 and "C" ring group 58. "C" ring group 58 is filled after "C" ring group shut-off valve 242 and C1 and C2 staging valves 234 and 236, respectively, are opened. After "C" ring group 58 is filled, "A" ring group shut-off valve 122 is closed and A1, A2, A3, and A4 purge valves 80, 82, 84, and 86, and "A" ring group drain valve 126 are opened. After approximately two minutes purging is complete, and "A" ring group drain valve 122 and A1, A2, A3, and A4 staging and purge valves 100, 102, 104, and 106, and 80, 82, 84, and 86, respectively, are closed.

As engine power is further decreased, fuel is supplied to "B" ring group 56 and "C" ring 202 and fuel flow to "C" ring 204 is decreased. During this fuel stage, C2 staging valve 236 is closed and C2 purge valve 222 is opened. After approximately two minutes, purging of C2 ring 204 is complete, and C2 purge valve 222 is closed.

As power is further decreased, fuel is supplied to only "B" ring group 56 and fuel is purged from C1 ring 202. Initially "C" ring group shut-off valve 242 is closed and C1 and C2 purge valves 220 and 222, C2 staging valve 236, and "C" ring group drain valve 248 are opened for approximately two minutes to complete the purging. After the purging is complete, C1 and C2 staging valves 234 and 236, C1 and C2 purge valves 220 and 222, and "C" ring group drain valve 248 are closed.

Whenever fuel flow to "B" ring group 56 is shut-off, "B" ring group 56 is purged after "B" ring group shut-off valve 166 is closed. "B" ring group drain valve 180 and "B" purge valve 174 are opened for purging. After approximately two minutes, "B" ring group 56 is purged, and "B" ring group drain valve 180 and "B" purge valve 174 are closed.

The above-described combustor is cost-effective and highly reliable. The combustor includes a fuel delivery system that effectively purges residual fuel from fuel supply rings and combustor pigtails and premixers that are not in use during a particular fuel stage. Because the backpurge system uses high temperature and high pressure combustor air, walls within non-flowing components are effectively drained and dried. As a result, auto-ignition of residual fuel is reduced. Furthermore, because the fuel delivery system includes a pair of orifices, load variations during fuel stage transitions are reduced. Thus, a combustor is provided which may be effectively purged at part power operations.

While the invention has been described in terms of various specific embodiments, those skilled in the art will recognize that the invention can be practiced with modification within the spirit and scope of the claims.

What is claimed is:

1. A gas turbine engine comprising:

a combustor; and a fuel delivery system comprising a plurality of fuel supply rings, at least one heat exchanger coupled to at least one of said plurality of fuel supply rings, and a backpurge system, said plurality of fuel supply rings configured to supply fuel to said combustor, said backpurge system in flow communication with said plurality of fuel supply rings and said combustor for using combustor air pressure for purging fuel from said fuel delivery system.

2. A gas turbine engine in accordance with claim 1 wherein said fuel delivery system backpurge system comprises at least one purge valve for selectively purging fuel from said combustor during turbine partial power operation.

3. A gas turbine engine in accordance with claim 1 wherein said backpurge system comprises at least one purge valve to facilitate reducing fuel auto-ignition within said fuel delivery system.

4. A gas turbine engine in accordance with claim 1 wherein said fuel delivery plurality of fuel supply rings comprise at least two orifices configured to reduce fuel pressure decay to said combustor.

5. A fuel delivery system in accordance with claim 1 wherein said plurality of fuel supply rings comprise at least one radially outer fuel ring, at least one intermediate fuel ring, and at least one radially inner fuel ring, said at least one outer fuel ring radially outward from said inner fuel ring, said at least one intermediate fuel ring between said at least one radially inward and outward fuel rings.

6. A fuel delivery system in accordance with claim 5 wherein said at least one radially inner fuel ring comprises at least two orifices configured to reduce fuel pressure decay to at least one of the combustor manifolds.

* * * * *